US006871931B2

(12) United States Patent
Kaneko

(10) Patent No.: US 6,871,931 B2
(45) Date of Patent: Mar. 29, 2005

(54) RECORDING APPARATUS AND RECORDING POSITION CORRECTING METHOD FOR RECORDING APPARATUS

(75) Inventor: Kenichi Kaneko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/445,986

(22) Filed: May 28, 2003

(65) Prior Publication Data

US 2003/0222936 A1 Dec. 4, 2003

(30) Foreign Application Priority Data

May 31, 2002 (JP) ..... 2002-160607

(51) Int. Cl.[7] ..... B41J 29/393
(52) U.S. Cl. ..... 347/19; 347/14; 347/37
(58) Field of Search ..... 347/19, 14, 178, 347/37

(56) References Cited

U.S. PATENT DOCUMENTS 6,353,485 B1 3/2002 Kaneko ..... 358/1.2
6,561,613 B2 * 5/2003 Cunnagin et al. ..... 347/19
6,607,260 B1 * 8/2003 Ikeda ..... 347/19

FOREIGN PATENT DOCUMENTS

JP 2000-238339 9/2000

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

There is provided a recording apparatus that carries out recording using a plurality of recording heads wherein the recording positions of the heads are automatically and accurately corrected, the heads being used to record inks of different colors. To accomplish this, offset measurement patterns with different ink colors are each adjusted so that a read output waveform and a threshold cross each other at a position intermediate between falling edges of the output waveform. Thus, an edge portion of each pattern is accurately detected.

12 Claims, 11 Drawing Sheets

RECORDING APPARATUS AND RECORDING POSITION CORRECTING METHOD FOR RECORDING APPARATUS

This application claims priority from Japanese Patent Application No. 2002-160607 filed May 31, 2002, which is incorporated hereinto by reference.

BACKGROUND OF THE INVENTION

1. Field of the Invention

The present invention relates to a recording apparatus and a recording position correcting method, and more specifically, to recording position corrections among a plurality of recording heads that record inks of different tones such as different colors or densities.

2. Description of the Related Art

To meet the recent need to record more colored images, some recording apparatuses comprise a plurality of recording heads on the same carriage or different carriages so that the respective recording heads can record the inks of the different tones. With such a recording apparatus, the recording heads are likely to be misaligned with respect to their ideal mounting positions owing to the insufficient accuracy of their dimensions or the insufficient accuracy with which they are mounted on the carriages. This misalignment may cause a recording position on a recording medium to deviate from the ideal one, resulting in the unwanted overlapping of the colors or a failure to allow them to overlap one another. As a result, the hue (color reproducibility) of a recorded image may change. Accordingly, corrections are desirably provided so that even if the mounting positions of the recording heads deviate from their ideal ones, each color can be recorded at the correct position during actual recording.

A correction method will be described below. That is, each recording head records a plurality of test patterns in such a manner that the recording heads use different recording timings. A user visually checks images of the recorded plurality of test patterns and determines and inputs the appropriate amount of correction. However, such a correction method imposes burdens on the user and is not sufficiently reliable.

Thus, the method described below has already been proposed as another solution. That is, a CCD sensor or the like is used to measure recorded test patterns. Then, on the basis of the results of the measurements, the amount of correction is calculated and thus automatically set. Further, Japanese Patent Application Laid-open No. 2000-238339 discloses an example that uses a reflection-type optical light-quantity sensor. The reflection-type optical light-quantity sensor enables the test patterns to be more accurately read and also enables corrections to be more accurately accomplished in a main scanning direction and a sub-scanning direction.

Here, brief description will be given of a method for using the reflection-type optical light-quantity to read test patterns to calculate the amount of correction. The reflection-type optical light-quantity sensor has a light emitting portion that emits light and a light receiving portion that receives reflected light. Then, measurement is made of the quantity of light in that part of the light emitted by the light emitting portion which is reflected and received by the light receiving portion. To accurately determine whether or not a recorded image is present, the emitted light is preferably focused on an area corresponding to the diameter of an ink dot on a recording medium. However, in this case, a small error in the mounting of the sensor results in a variation in the quantity of light reflected. Thus, in the prior art, light is emitted to a relatively large area so that the edge of a test pattern image can be estimated from the [averaged] output change of the received reflected light. The amount of correction is thus calculated.

FIG. 6 is a diagram showing test patterns on a sheet and output waveforms obtained when the test patterns are read by the reflection-type optical light-quantity sensor. In the described example, test patterns 601 and 602 are read to obtain the amount of correction. The sensor outputs a signal corresponding to the quantity of light received while moving in the direction shown by the arrows in the figure. Reference numeral 604 denotes the quantity of light received when the test patterns 601 and 602 are read. This figure indicates that a portion of the sheet in which the pattern is present reflects a smaller amount of light than a blank portion and has a smaller output value. Thus, an appropriate threshold 606 is set and a counting operation is performed during a section T1 starting with the first falling position and ending with the second falling position. Then, a count C1 obtained is used to determine the distance between the two patterns. With this measuring method, the offset of the recording position can be determined for each recording head. When an actual image is recorded, this offset is corrected to control the recording position. Thus, each color is recorded at the correct position. The hue (color reproducibility) of the recorded image is prevented from changing.

Such a reflection-type optical light-quantity sensor is also called a "reflection-type photo interrupter". It is more inexpensive and has more applications than optical sensors such as CCDs. Accordingly, in recent years, it has been often applied to ink jet printers for general users and the like. The offset of the recording positions among recording heads for different colors has been automatically and accurately corrected using an inexpensive refection-type photo interrupter.

However, light emitted by the reflection-type photo interrupter has an intensity distribution around a specific wavelength. This prevents a variation in light reflected from an edge of an image recorded with a color from being distinguished from a variation in light reflected from an edge of an image recorded with another color. This may result in an error in measurement carried out by a recording apparatus that corrects a plurality of ink colors.

Referring back to FIG. 6, the above problem will be described in detail. In this figure, reference numerals 601 and 602 denote test patterns recorded using the same color ink. Reference numeral 603 denotes a test pattern recorded using a different color ink. Reference numeral 604 denotes an output waveform obtained by reading the test patterns 601 and 602. Reference numeral 605 denotes an output waveform obtained by reading the test patterns 601 and 603. The test patterns 601 and 602 are recorded using the same color ink. Those portions of the output waveforms which correspond to the presence of these test patterns have similar curves. Accordingly, the distance between both patterns can be substantially accurately measured. However, the output waveform 605 obtained by executing measurements for the different color inks has a different curve shape because of the different colors in spite of the same width possessed by both test patterns 601 and 603. Specifically, there is a difference between the level L1 of quantity of light reflected when the test pattern 601 is read (a difference in the quantity of light reflected between a blank portion and the center of the pattern) and the level L2 of quantity of light reflected when the test pattern 603 is read. A small misalignment $\Delta T$ caused by the difference between L1 and L2 occurs where the falling positions concerning different colors are determined by using the same threshold 606. This is recognized as the offset of recording position of the pattern.

With a color printer using a plurality of ink colors, the magnitude of an error such as ΔT varies with the color. Colors absorbing more emitted light allow the test pattern to be detected as a larger image.

Then, this is determined to be the offset of recording position of each recording head, leading to a measurement error. Further, a similar problem occurs if two types of inks are used which has the same color but different densities.

SUMMARY OF THE INVENTION

In view of the above problems, it is an object of the present invention to provide a recording apparatus that carries out recording using a plurality of recording heads wherein the recording positions of the heads are automatically and accurately corrected, the heads being used to record inks of different tones.

In a first aspect of the present invention, there is provided a recording apparatus that forms an image by relatively scanning a recording medium and a plurality of recording heads used to apply recording agents of different color tones to the recording medium, the apparatus comprising:

- image forming means for causing each of the plurality of recording heads to form a predetermined image at a predetermined position of the recording medium;
- image detecting means for detecting the predetermined image by being scanned relative to the recording medium;
- image detection adjusting means for adjusting the image detecting means when detecting the predetermined image formed by each of the plurality of recording heads;
- measurement means for measuring an interval between the predetermined images formed by the plurality of recording heads on the basis of output results obtained by the image detecting means; and
- data processing means for calculating the amount of offset of a recording position among the plurality of recording heads on the basis of the measurement made by the measuring means.

In a second aspect of the present invention, there is provided a recording position correcting method for a recording apparatus that forms an image by relatively scanning a recording medium and a plurality of recording heads used to apply recording agents of different color tones to the recording medium, the method comprising:

- an image forming step of causing each of the plurality of recording heads to form a predetermined image at a predetermined position of the recording medium;
- an image detecting step of detecting the predetermined image using image detecting means scanned relative to the recording medium;
- an image detection adjusting step of adjusting the image detecting means when detecting the predetermined image formed by each of the plurality of recording heads;
- a measurement step of measuring an interval between the predetermined images formed by the plurality of recording heads on the basis of output results obtained in the image detecting step;
- a data processing step of calculating the amount of offset of a recording position among the plurality of recording heads on the basis of the measurement; and
- a step of recording the images while correcting the amount of offset obtained by the data processing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described below in detail with reference to the drawings.

(1) First Embodiment (1.1) Example of Configuration of a Recording Apparatus

Figure 1:
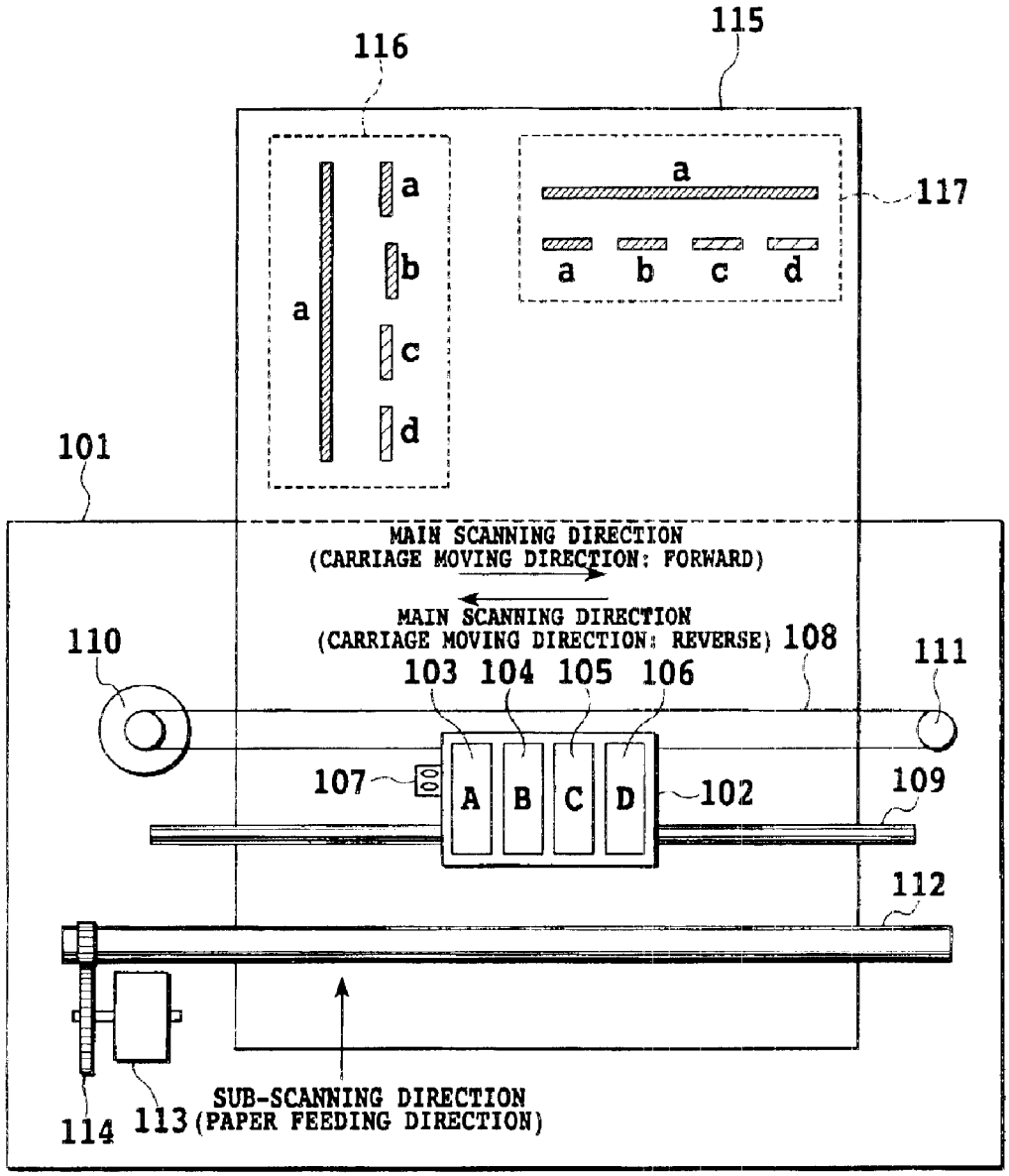
FIG. 1 is a schematic plan view schematically showing a configuration of a serial-type ink jet recording apparatus as a recording apparatus to which the present invention is applicable.

FIG. 1 is a diagram showing an example of configuration of a serial printer to which the present invention is applicable.

In FIG. 1, a serial printer 101 according to the present embodiment comprises a carriage 102 on which recording heads are mounted. Separate recording heads A, B, C, and D, denoted by reference numerals 103, 104, 105, and 106, respectively, are mounted on the carriage 102. In this case, the plurality of recording heads correspond to inks of a plurality of colors (for example, black, yellow, magenta, and cyan) used to record color images.

A reflection-type optical light-quantity sensor 107 (hereinafter also simply referred to as a "sensor") as an optical sensor is attached to the carriage 102. The sensor 107 performs a detection operation while moving in union with movement of the carriage in the main scanning direction. Alternatively, the sensor 107 is stationary along with the carriage and performs a detection operation while a recording medium is transferred.

The carriage 102 on which the recording heads A to D are mounted is reciprocated in a lateral direction (main scanning direction) of the drawing along a guide rail 109 by a belt 108 driven by a carriage motor 110 and supported by a pulley 111. Further, a recording medium 115 is transferred in a sub-scanning direction perpendicular to the main scanning direction by a transfer roller 112 rotatably driven by a motor 113 via a transmission gear 114.

Two groups on the recording medium 115 enclosed by broken lines show a pattern 116 used for recording position correction processing in the main scanning direction and a pattern 117 used for recording position correction processing in the sub-scanning direction, respectively.

In the example in FIG. 1, all the plurality of recording heads are mounted on the single carriage 102. However, some or all of the plurality of recording heads may be mounted on a plurality of independent carriages.

Further, ink tanks that contain inks as recording agents may be inseparable from an ejecting portion or detachable from it. In the former case, a cartridge is formed so that each recording head is integrated with the corresponding ink tank. When the ink in a certain tank has been consumed, the whole cartridge including this ink tank is replaced with a new one. On the other hand, in the latter case, only the ink tank is replaced with a new one. Alternatively, the recording heads mounted on the carriage 102 may be supplied with the corresponding inks from the respective ink tanks via tubes or the like, the ink tanks being provided in a site of the apparatus which is separate from the carriage.

The ejecting portion may use, as energy generating means for ejecting the ink, an electrothermal transducer element (ejection heater) for generating heat energy that subjects the ink to film boiling in response to electric conduction.

Figure 9:
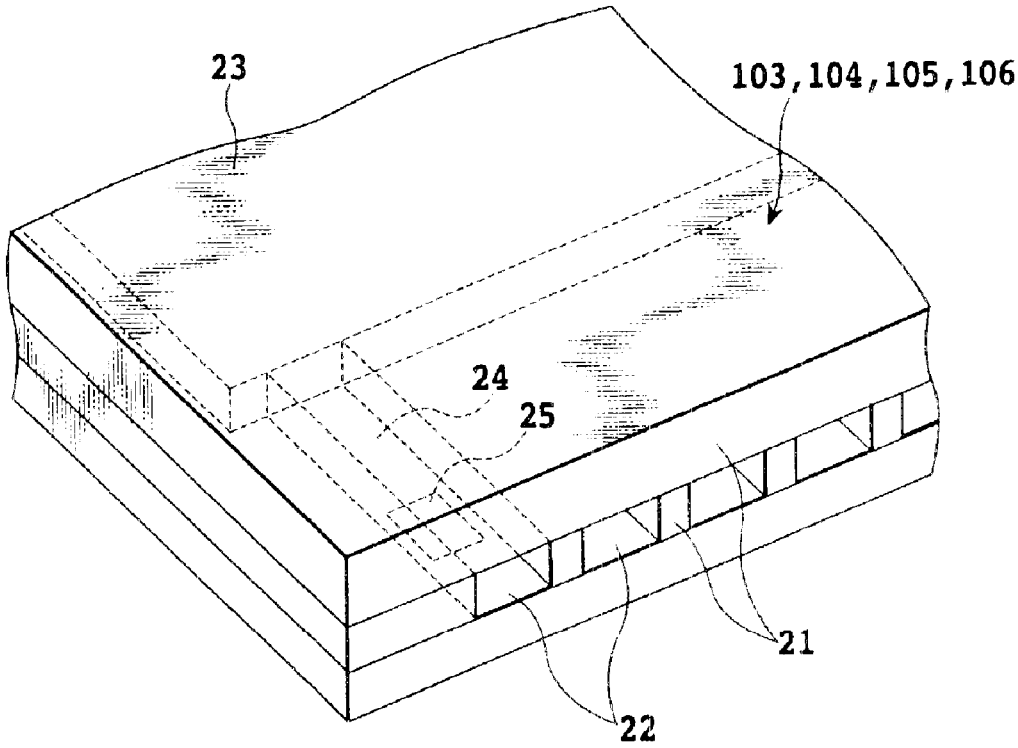
FIG. 9 is a perspective view schematically showing an example of structure of essential parts of a print head in the apparatus shown in FIG. 1.

FIG. 9 is a schematic perspective view partly showing a structure of the ejecting portion of the recording head.

In FIG. 9, a plurality of ejection openings 22 are formed on a head face 21 at a predetermined pitch, the head face 21 being located opposite the recording medium 115 so as to have a predetermined clearance between them. Each ejection opening 22 and a common liquid chamber 23 communicate with each other via a liquid passage 24. The electrothermal transducer element (exothermic resistant element or the like) 25 is arranged on each liquid passage 24 to generate energy utilized to eject the ink. In the present example, each of the recording heads is installed on the carriage 102 so that the ejection openings 22 lie in a line in a direction crossing the main scanning direction. With the above configuration, the electrothermal transducer element 25 is driven (energized) on the basis of an image signal or an ejection signal to subject the ink in the corresponding liquid passage 24 to film boiling. Then, generated pressure is used to eject the ink from the corresponding ejection opening 22.

Figure 2:
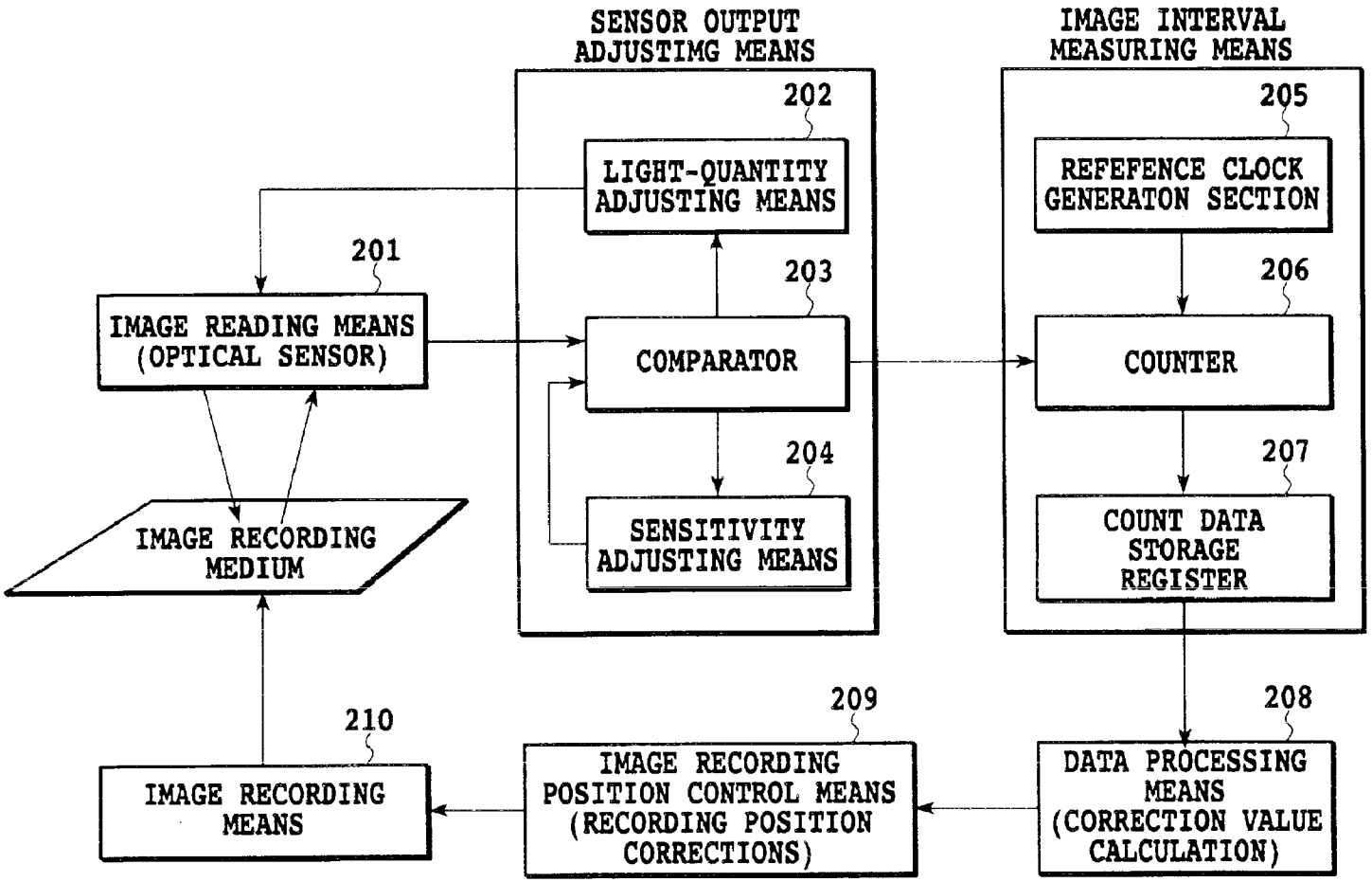
FIG. 2 is a block diagram showing essential parts of a control system of the apparatus in FIG. 1 which carries out recording position corrections according to the present invention.

FIG. 2 is a block diagram specifically showing essential arrangements of a control system of the serial printer system shown in FIG. 1, the arrangements being used to execute recording position correction processing, described later.

In FIG. 2, image reading means 201 includes the above reflection-type optical light-quantity sensor 107, mounted on the carriage 102. The image reading means 201 reads recorded image data (test patterns or the like) used for the recording position correction processing. Sensor output adjusting means executes processing required to adjust the emission output and reception sensitivity of the sensor 107. The sensor output adjusting means is composed of a comparator 203 for shaping the waveform of an output signal from the sensor 107, a sensitivity adjusting portion 204 that determines a threshold, and a light-quantity adjusting portion 202 that determines the level of quantity of light for the sensor 107. Image interval measuring means executes processing required to measure the interval between patterns used for the recording position correction processing. The image interval measuring means has a reference clock generation section 205 that generates a reference clock, a counter 206 that counts the shaped sensor output signals on the basis of the reference clock, and a register 207 that stores the count.

Data processing means 208 calculates a correction value used to correct the recording position on the basis of the count stored in the register 207. Then, image recording position control means 209 controls the driving of image recording means 210 including the recording heads, on the basis of the correction value. Consequently, images are recorded without any offset.

The control system in FIG. 2 may all be composed of hardware, or some of the predetermined functions (data processing means 208 and others) may be carried out by software for a CPU provided in the recording apparatus.

Now, description will be given of a method for automatically correcting the image recording positions of the plurality of recording heads in connection with the serial printer configured as shown in FIG. 1.

Figure 3:
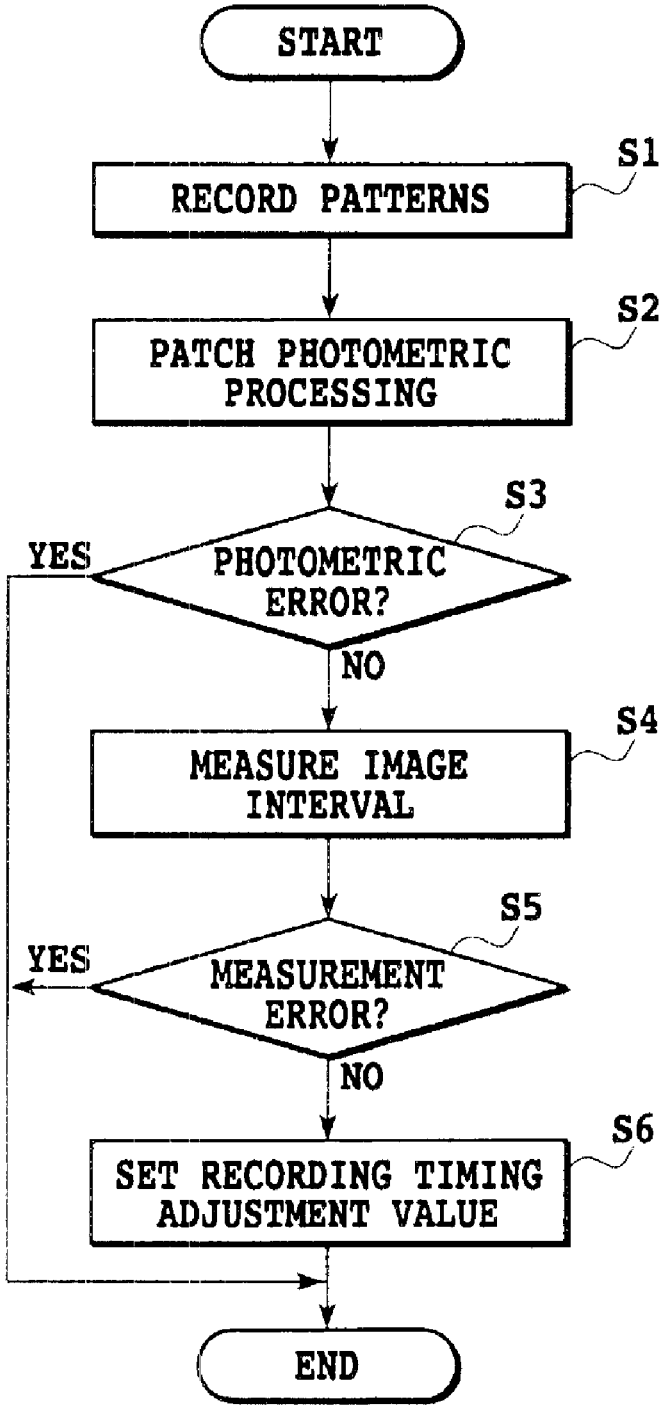
FIG. 3 is a flow chart showing an example of a process procedure in an automatic correction mode of the recording apparatus according to the present invention.

(1.2) Adjustment of Quantity of Light for the Reflection-Type Optical Light-Quantity Sensor FIG. 3 is a flow chart showing an automatic correction mode used to determine a correction value for the recording position.

In FIG. 3, when the automatic correction mode is started, the recording heads are used to record a predetermined pattern (step S1).

Figure 4:
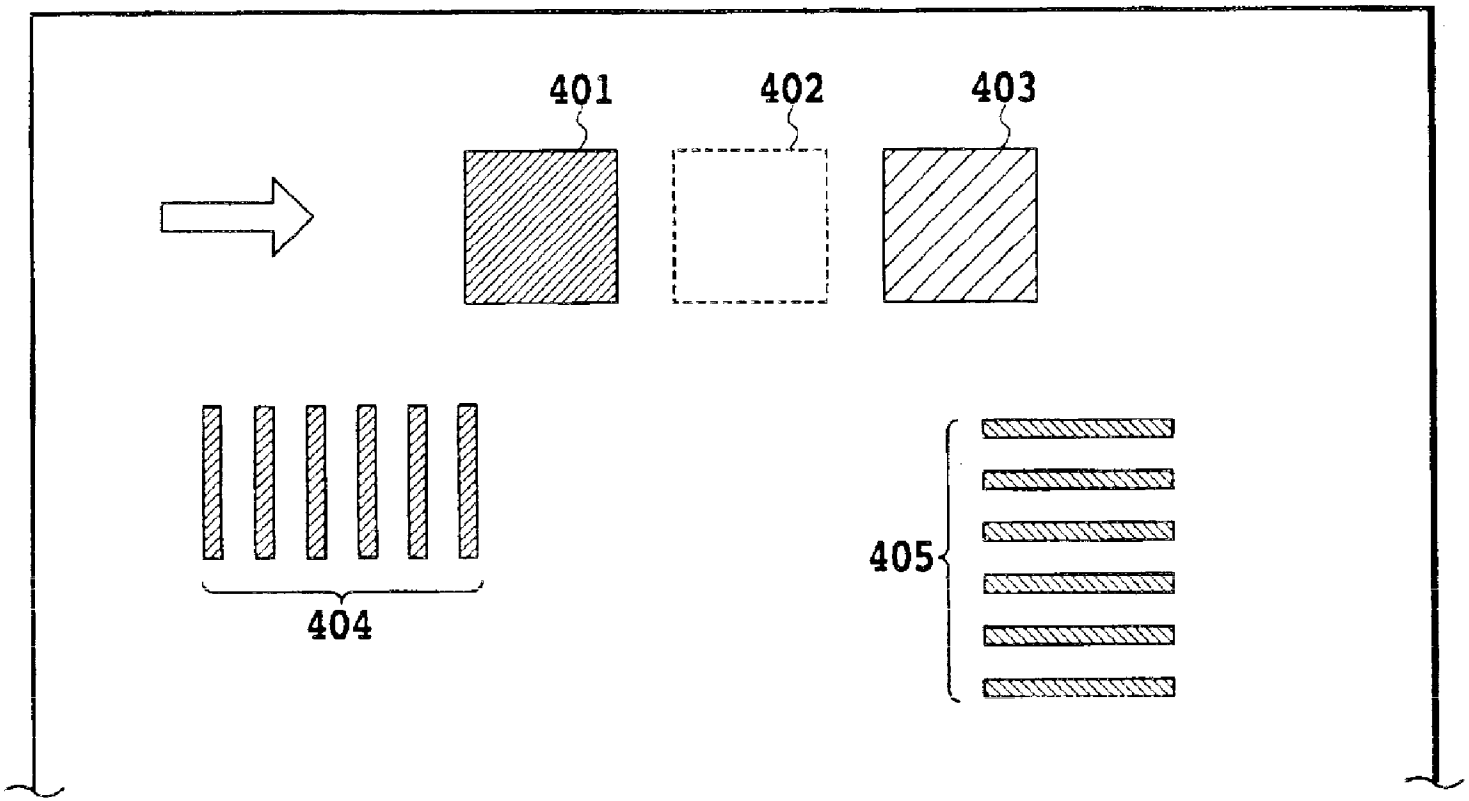
FIG. 4 is a diagram showing an example of a test chart used in the automatic correction mode of the recording apparatus according to the present invention.

FIG. 4 shows an example of a pattern recorded in step S1. Reference numerals 401 to 403 denote patches used to adjust the quantity of light emitted by the sensor. Reference numeral 401 denotes a black patch recorded with the recording head A and having its recording rate adjusted so as to exhibit a reflection optical density (hereinafter simply referred to as a "density") of 50% compared to a solid-printed black image. Reference numeral 402 denotes an area used to measure a blank portion of the recording medium. Reference numeral 403 denotes a patch recorded with the recording head B and having its recording rate adjusted so as to exhibit a reflection optical density (hereinafter simply referred to as a "density") of 50% compared to a solid-printed cyan. Similar patches are recorded using the recording heads C and D. However, for simplification, description will be given only of the cyan patch recorded using the recording head B.

Reference numerals 404 and 405 denote patterns used to measure the amount of offset of recording position of each recording head in the main scanning direction and in the sub-scanning direction, respectively. Although FIG. 4 shows a simplified configuration, the lines constituting these patterns are recorded with different ink colors. Further, the layout of the lines is not limited to those shown at 404 and 405, but may be as shown at 116 and 117 in FIG. 1.

In step S2 in FIG. 3, the patches 401 to 404 recorded in step S1 are subjected to photometric processing. First, the carriage 102 is moved in the direction of the arrow in FIG. 4 from the left of this figure to a position where the sensor 107 mounted on the carriage 102 can carry out the photometric processing at an almost central area of the patch 401. Then, a light quantity level for the sensor light emitting portion is gradually increased while a threshold for the comparator 203 is fixed to a predetermined value. Then, a light quantity level for black is determined to be the one obtained when the sensor reacts, i.e., when the quantity of light received is almost equal to the fixed predetermined threshold. This operation is preformed for the areas 402 and 403 and for the other colors.

Description will be given of the reason why a halftone, which has a density of 50%, is used to adjust the quantity of light.

Figure 5:
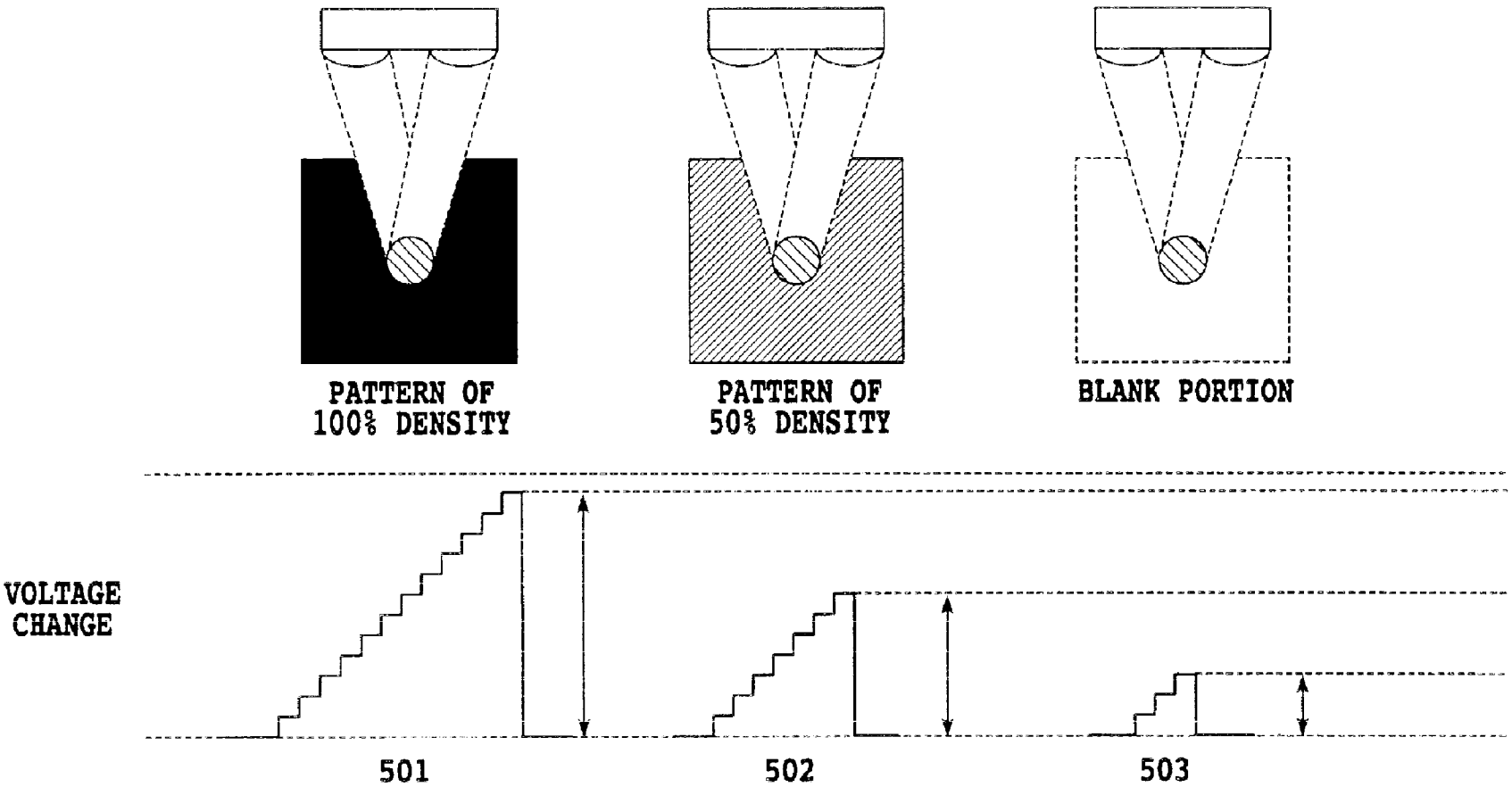
FIG. 5 is a diagram showing the relationship between the density measured by a reflection-type optical light-quantity sensor and the quantity of light emitted.
Figure 6:
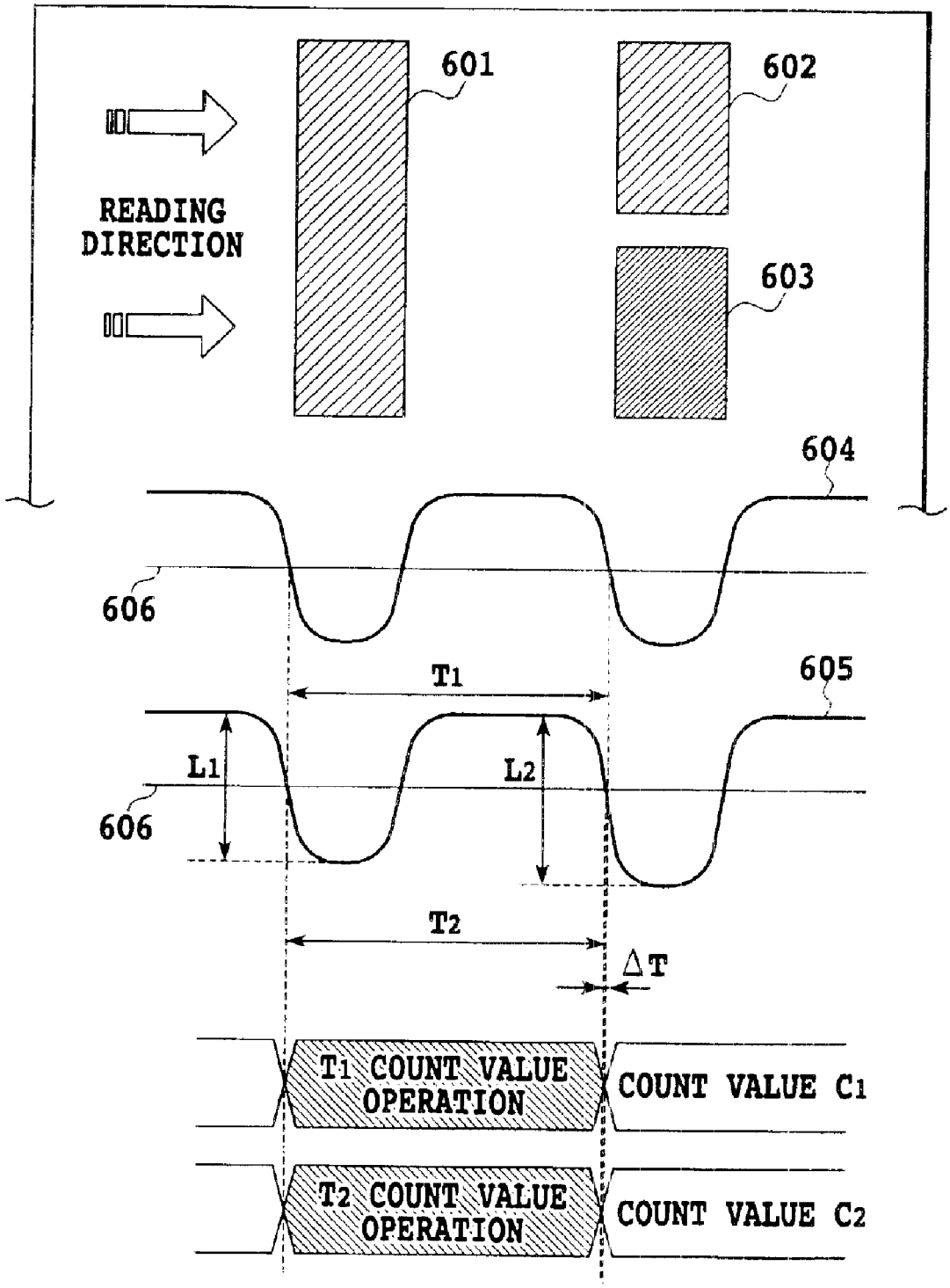
FIG. 6 is a drawing for describing an error in reading carried out by the reflection-type optical light-quantity sensor.

FIG. 5 shows that three black patches of different densities are used and that the light quantity level is gradually increased with the threshold fixed to the predetermined value until the sensor reacts (the threshold is exceeded). Reference numeral 501 denotes a patch of 100% density, which requires a large quantity of light to exceed the threshold. Reference numeral 503 denotes a blank patch, on which nothing is recorded and which causes the sensor to react with a small quantity of light. Reference numeral 502 denotes a patch of 50% density, which exhibits a value almost intermediate between the values exhibited by the patches 501 and 503. An object of the present invention is to precisely distinguish the pattern of 100% density from the blank portion to accurately detect an edge portion of the pattern. Thus, the position of the recorded pattern is accurately detected by adjusting the light quantity level for the sensor light emitting portion to a value equal to that of the threshold equal to the intermediate between both levels, i.e., the value corresponding to a density of about 50%. However, in the present embodiment, the density of the above pattern is not necessarily limited to 50%. The present embodiment is effective provided that a proper density is used which is between 0 and 100% and which allows the blank portion to be reliably distinguished from the pattern of 100% density.

In step S3 in FIG. 3, processing is executed which is required if an error occurs. The term "error" as used herein refers to the case in which the light quantity level obtained from a patch of a certain color is lower than that obtained from the blank portion 402 or the case in which the sensor does not react with any levels before the light quantity level reaches 100%. In this case, the user is notified of the error and the photometric processing is terminated.

Steps S1 to S3, described above, comprise the adjustment of the sensor light quantity.

(1.3) Corrections in the Main Scanning Direction for a Plurality of Heads

In step S4 and the succeeding steps, the sensor light quantity adjusted as described above is used to actually measure the amount of offset to determine a correction value. Here, first, with reference to FIG. 10, description will be given of corrections for the plurality of heads during main scanning.

Figure 10:
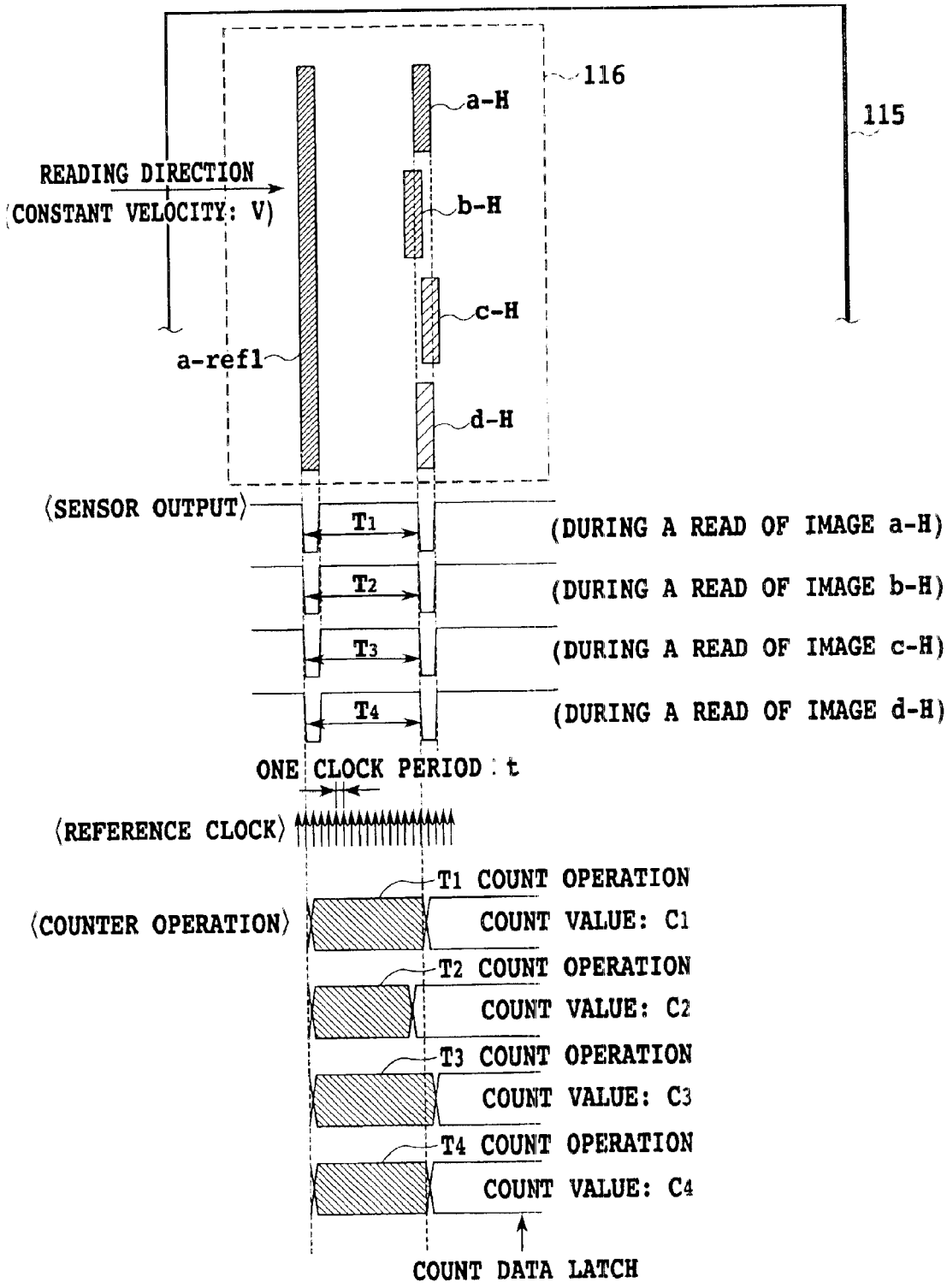
FIG. 10 is an explanatory drawing for describing correction processing executed for a plurality of heads during main scanning.

In step S4, offset measuring patterns are subjected to photometric processing while changing the quantity of light depending on the light emission level for each color obtained in step S2. In FIG. 10, the pattern layout 116 in FIG. 1 is used.

This layout will be described in brief. A reference image a-ref1 is recorded with black using the recording head A. This pattern is used as a reference for measuring the distances to the plurality of other patterns. Reference characters a-H, b-H, c-H, and d-H denote images recorded with black, cyan, magenta, and yellow, respectively, using the recording heads A, B, C, and D, respectively. The image data in these patterns are arranged parallel with the reference image a-ref1 and linearly in the sub-scanning direction. Thus, in a recorded image, unless the recording positions of the recording heads deviate from the theoretical ones, the patterns are linearly arranged and are at an equal distance to the reference image a-ref1 in the main scanning direction. However, various errors generally occur to cause the patterns to be misaligned with respect to one another as shown in FIG. 10.

An actual reading operation will be described below. First, the recording medium 115 is transferred and stopped to a position where the sensor can read the reference image a-ref1 and the recorded image a-H during a single main scanning operation. Then, with the recording medium 115 fixed, the recorded images are read while moving the carriage at a constant velocity V in the forward main scanning direction. The quantity of light emitted by the sensor used to read the images a-ref1 and a-H at this time is already set at the value obtained in step S2, i.e., the value for black obtained by reading the patch 401.

Then, the recording medium is further transferred in the sub-scanning direction and fixed to a position where the sensor can read the reference image a-ref1 and the recorded image b-H during a single main scanning operation. Then, the recorded images are read while moving the carriage at the constant velocity V in the forward main scanning direction as previously described. However, in this case, the reference image a-ref1 is subjected to photometric processing using the quantity of light for black as described above, but for the recorded image b-H, the quantity of light is switched to the one for cyan obtained by reading the patch 403 in step S2.

Figure 7:
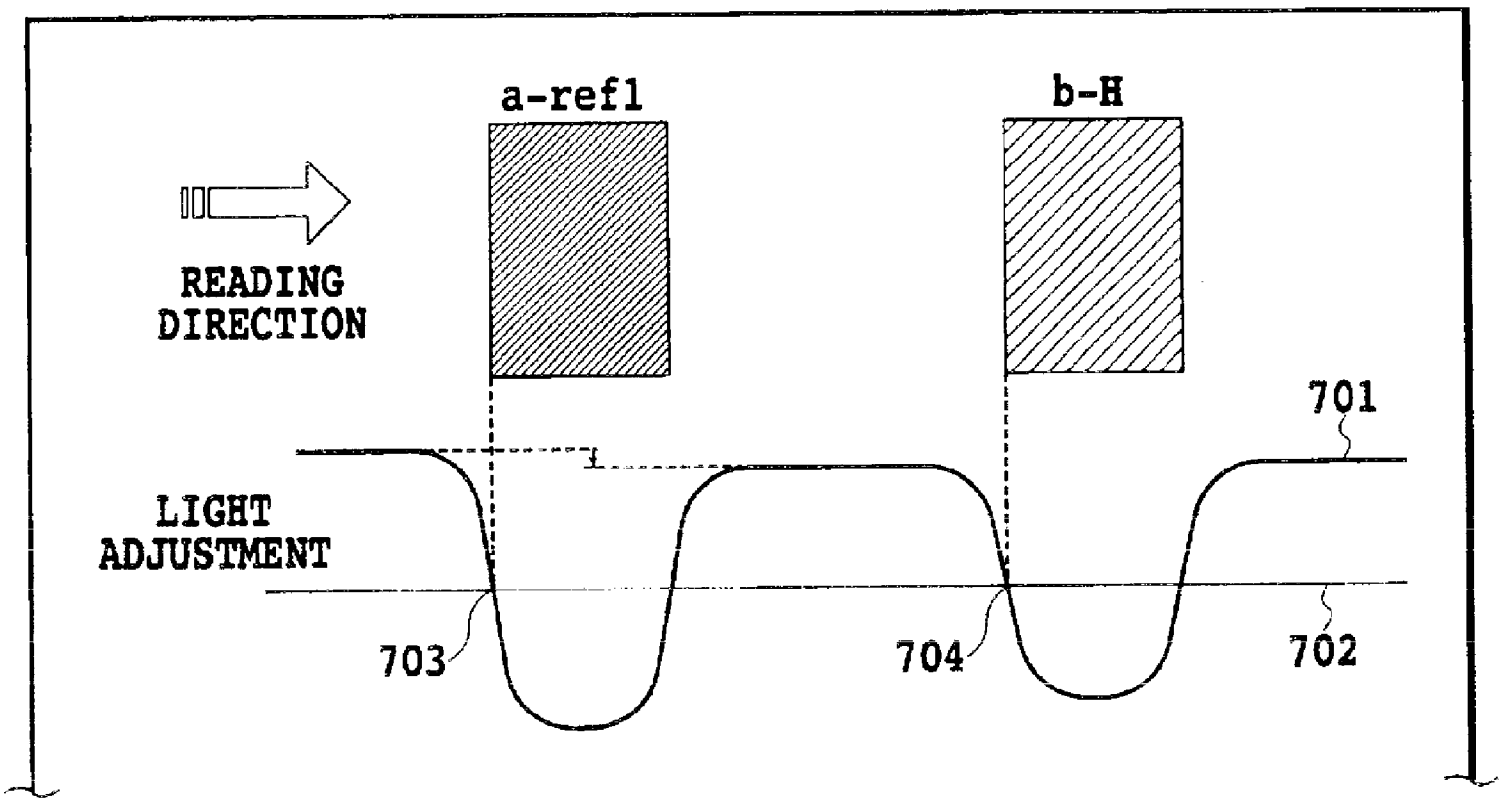
FIG. 7 is a drawing for describing pattern reading control according to a first embodiment of the present invention.

FIG. 7 shows an output voltage 701 from the sensor which is obtained when the images a-ref1 and b-H are read. FIG. 7 indicates that after the reference image a-ref1, recorded with the black ink, has been read, the light quantity level is lowered to that for cyan.

Thus, even if the two patches (a-ref1 and b-H) with different color tones are read, timings 703 and 704 for falling edges, which edges appear when the sensor passes over edges of both patches, are almost equal.

Consequently, the positions of the edges shown by the dot lines are recognized at almost the same level.

Such a waveform is an output signal from the sensor output adjusting means in FIG. 2. It is outputted to the counter 206 of the image interval measuring means as it is. The counter 206 is triggered when the output signal exhibits a value smaller than a falling edge threshold. The counter 206 then keeps counting up till the next falling edge. The lower part of FIG. 10 shows the <reference clock> waveform obtained and the <counter operation> performed during the corresponding period.

In step S5 in FIG. 3, it is checked whether or not the count value obtained is valid. If the counter overflows during the measurement, it is determined that a measurement error has occurred to terminate the photometric processing. If the counter value is valid, it is stored in a count data storage register.

In step S6, the data processing means 208 in FIG. 2 calculates the amount of offset of the main scanning recording position among the plurality of heads. It then sets the value obtained as an adjustment value used when an actual image is recorded. The amount of offset is calculated as follows:

If the following definitions are made:

velocity at which the carriage moves during image reading: V, clock number count value obtained over a period T1 from the point at which the reference image a-ref1 recorded by the recording head A is recognized and to the point at which the recorded image a-H recorded by the recording head A is recognized: C1, clock number count value obtained over a period T2 from the point at which the reference image a-ref1 recorded by the recording head A is recognized and to the point at which the recorded image b-H recorded by the recording head B is recognized: C2, clock number count value obtained over a period T3 from the point at which the reference image a-ref1 recorded by the recording head A is recognized and to the point at which the recorded image c-H recorded by the recording head C is recognized: C3, clock number count value obtained over a period T4 from the point at which the reference image a-ref1 recorded by the recording head A is recognized and to the point at which the recorded image d-H recorded by the recording head D is recognized: C4, and one clock period of the reference clock inputted to the counter: t, then the amount of offset of the main scanning direction recording position for each recording head is determined by "(C1−Cn)×t×V"(n=2, 3, 4) to obtain the amounts of offset of the recording positions of the other heads observed if the recording head A is used as a reference.

Subsequently, on the basis of the amounts of offset determined, an adjustment value for correction is set for each recording head. Then, the automatic correction mode is completed.

To actually record images, the image recording means 210 is controlled using the adjustment value for each recording head set in step S6. A number of methods are available for making corrections in the main scanning direction. For example, an ejection timing for each recording head may be changed among the colors. Alternatively, inputted image data may be decomposed into image planes for the respective recording heads, which may then be arranged offset from one another. These methods enable the recording position of each recording head in the main scanning direction to be corrected to obtain images that are properly aligned with one another.

In the method for measuring the amount of offset in the main scanning direction described above, the patterns shown in FIG. 10 are used. However, for example, the patterns shown at 404 in FIG. 4 may also be used for measurement. At patterns 404 in FIG. 4, the lines are actually recorded with the different ink colors using the different recording heads. Then, the distance from one of the lines used as a reference to each of the other lines is measured, the other lines being each recorded at a corresponding theoretical distance from the reference line. The difference between the determined distance and the theoretical value is then determined as the amount of offset.

(1.4) Corrections in the Sub-Scanning Direction for a Plurality of Heads

Description will be given of the case in which corrections in the sub-scanning direction are made as processing in step S4 and the succeeding steps in FIG. 3.

Figure 11:
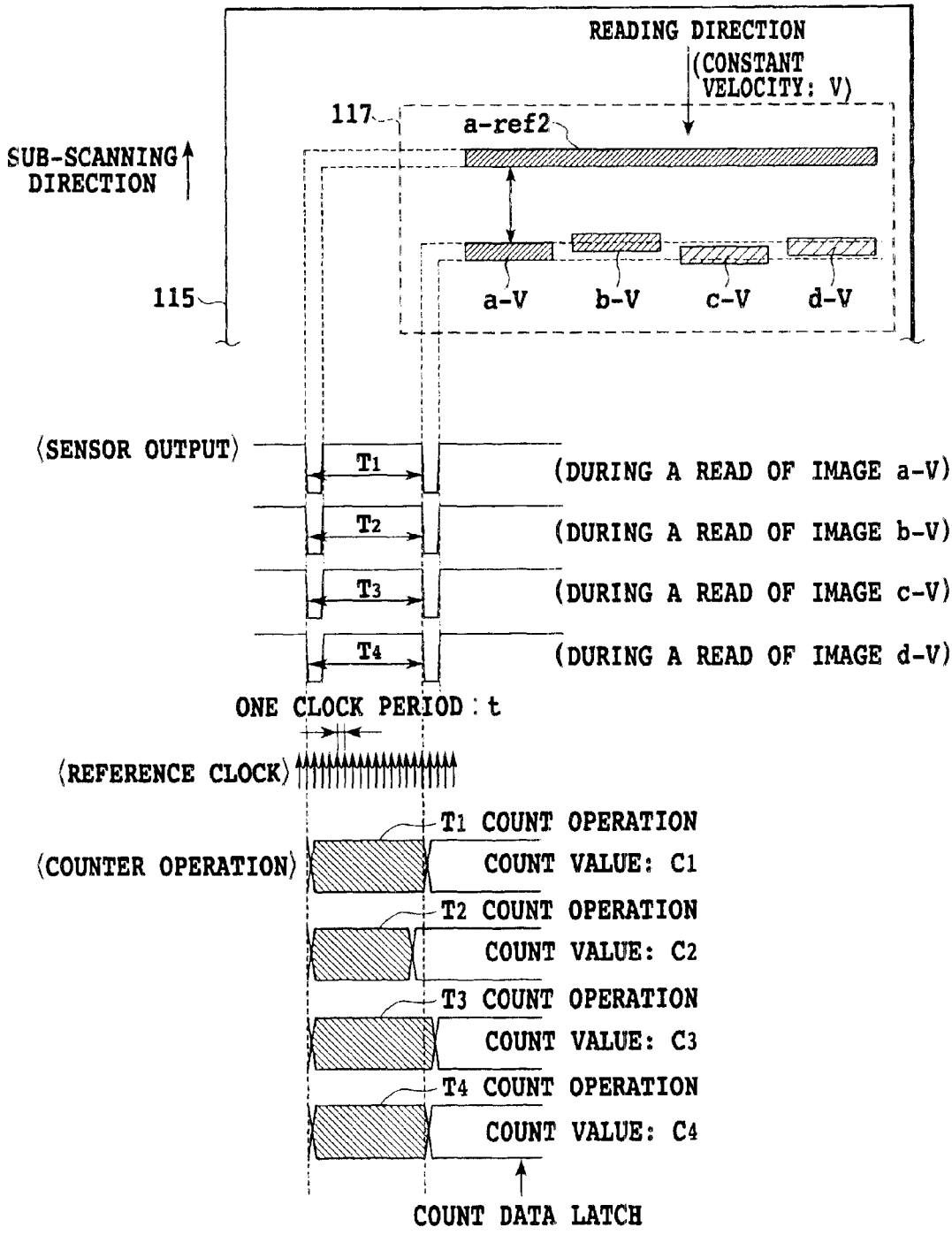
FIG. 11 is an explanatory drawing for describing correction processing executed for the plurality of heads during sub-scanning.

FIG. 11 is an explanatory drawing for a method for determining the offset of the recording position in the sub-scanning direction. In this case, the patterns shown at 117 in FIG. 1 are used to measure the amount of offset in the sub-scanning direction.

This layout will be described in brief. A reference image a-ref2 is recorded with black using the recording head A. This pattern is used as a reference for measuring the distances to the plurality of other patterns. Reference characters a-V, b-V, c-V, and d-V denote images recorded with black, cyan, magenta, and yellow, respectively, using the recording heads A, B, C, and D, respectively. The image data in these patterns are arranged parallel with the reference image a-ref2 and linearly in the sub-scanning direction. Thus, in a recorded image, unless the recording positions of the recording heads deviate from the theoretical ones, the patterns are linearly arranged and are at an equal distance to the reference image a-ref2 in the main scanning direction. However, various errors generally occur to cause the patterns to be misaligned with respect to one another as shown in FIG. 11.

An actual reading operation will be described below. First, the carriage is moved to a position where both reference image a-ref2 and recorded image a-V can be read during a single paper feed transfer operation. Then, with the carriage fixed, the recorded images are read while moving the carriage at the constant velocity V in the sub-scanning direction. The quantity of light emitted by the sensor used to read the images a-ref2 and a-V at this time is already set at the value obtained in step S2 in FIG. 3. That is, the quantity of light is already set at the value for black obtained by reading the patch 401.

Then, the recording medium is reversely transferred to its original position. On the other hand, the carriage is moved to and stopped at a position where the reference image a-ref2 and the recorded image b-V can be read during a single sub-scanning operation. Then, the recorded images are read while transferring the paper at the constant velocity V in the sub-scanning direction as previously described. However, in this case, the reference image a-ref2 is subjected to photometric processing using the quantity of light for black as described above, but for the recorded image b-V, the quantity of light is switched to the one for cyan obtained by reading the patch 403 in step S2.

In this manner, it is possible to obtain, in the sub-scanning direction, effects equivalent to those obtained in the reading in the main scanning direction as described in FIG. 7. That is, even if patches with different color tones are read, the quantity of light emitted can be adjusted for each color so as to substantially equalize timings for falling edges between the colors, the falling edges appearing when the sensor passes over edges of the patches. Consequently, the positions of edges of the patterns are recognized almost equivalently for all colors.

In FIG. 2, a waveform obtained is outputted to the counter 206 of the image interval measuring means. The counter 206 is triggered when a signal value exhibits a value smaller than the falling edge threshold. The counter 206 then keeps counting up till the next falling edge. The lower part of FIG. 11 shows the <reference clock> waveform obtained and the <counter operation> performed during the corresponding period.

In FIG. 3, in step S5, it is checked whether or not a count value obtained is valid. If the counter overflows during the measurement, it is determined that a measurement error has occurred to terminate the photometric processing. If the counter value is valid, it is stored in the count data storage register 207.

In step S6, the data processing means 208, shown in FIG. 2, calculates the amount of offset of the sub-scanning recording position among the plurality of heads. It then sets the value obtained as an adjustment value used when an actual image is recorded. The amount of offset is calculated as follows:

If the following definitions are made:

velocity at which the paper is transferred during image reading: V, clock number count value obtained over a period T1 from the point at which the reference image a-ref2 recorded by the recording head A is recognized and to the point at which the recorded image a-V recorded by the recording head A is recognized: C1, clock number count value obtained over a period T2 from the point at which the reference image a-ref2 recorded by the recording head A is recognized and to the point at which the recorded image b-V recorded by the recording head B is recognized: C2, clock number count value obtained over a period T3 from the point at which the reference image a-ref2 recorded by the recording head A is recognized and to the point at which the recorded image c-V recorded by the recording head C is recognized: C3, clock number count value obtained over a period T4 from the point at which the reference image a-ref2 recorded by the recording head A is recognized and to the point at which the recorded image d-V recorded by the recording head D is recognized: C4, and one clock period of the reference clock inputted to the counter: t, then the amount of offset of the sub-scanning direction recording position for each recording head is determined by "(C1−Cn)×t×V"(n=2, 3, 4). This determines the amounts of offset of the recording positions observed if the recording head A is used as a reference.

Subsequently, an adjustment value for correction is set for each recording head. Then, the automatic correction mode is completed.

To actually record images, the image recording means 210 is controlled using the adjustment value for each recording head set in step S6. A number of methods are available for making corrections in the sub-scanning direction. For example, the range of array of ink ejection openings in the respective recording heads (ejection portions) is set to be larger than the band width of an image formed during a single main scanning operation so that, during recording, the range of ejection openings used may be shifted according to the amount of correction. Alternatively, inputted image data may be decomposed into image planes for the respective recording heads, which may then be arranged offset from one another. These methods enable the recording position of each recording head in the sub-scanning direction to be corrected to obtain images that are properly aligned with one another.

In the method for measuring the amount of offset in the sub-scanning direction described above, the patterns shown in FIG. 11 are used. However, for example, the patterns shown by reference numeral 405 in FIG. 4 can also be used for measurement. At patterns 405 in FIG. 4, the lines are recorded with the different ink colors using the different recording heads. The distance from one of the lines used as a reference to each of the other lines is measured. The difference between the determined distance and its theoretical value can then be determined as the amount of offset.

In the above, referring to step S4 and the succeeding steps, the methods for reading the offset of recording position of each recording head corresponding to the main scanning direction and the sub-scanning direction were described, respectively. However, actually, the patterns may be simultaneously recorded as shown in FIG. 1 or FIG. 4 and measurements may be made during the same step. In either correction, it is possible to effectively utilize the adjustment value for the quantity of light emitted by the sensor which value is obtained in step S2.

Furthermore, in the patterns in FIG. 4 and the flow chart in FIG. 3, the patterns for adjusting the light quantity level and the patterns for measuring the amount of offset among the recording heads are recorded on the same recording medium so that the amount of offset is measured immediately after the light quantity level is adjusted. However, the present invention and the present embodiment are not limited to this aspect. If the adjustment of the light quantity level is not carried out as frequently as the measurement of amount of offset, it is allowable to provide a mode in which only the adjustment of the light quantity level is carried out and a mode in which only the measurement of amount of offset is carried out to execute each mode as required. However, it is strongly desirable that whenever the amount of offset is measured, an appropriate light quantity level is specified.

As described above, according to the present embodiment, the level of quantity of light emitted by the reflection-type optical light-quantity sensor is adjusted for each ink color, and measurement is then made of the amount of offset in the main scanning direction or the sub-scanning direction. With this method, the sensor reading errors have been reduced to enable the offset of the recording position to be more accurately corrected.

(2) Second Embodiment

A second embodiment of the present invention will be described below. The following points of the present embodiment are similar to those of the first embodiment: the configuration of the recording apparatus, described in FIGS. 1, 2, and 9, the method for measuring the amount of offset of the recording position, described in FIGS. 10 and 11, and the flow of the automatic correction mode, described in FIG. 3.

The present embodiment differs from the first embodiment in the adjustment method executed by the sensor output adjusting means, shown in FIG. 2. In the first embodiment, to accurately read the positions of the patterns for measuring the amount of offset, the light-quantity adjusting portion 202 adjusts, for each ink color, the quantity of light emitted by the reflection-type optical light-quantity sensor. In contrast, in the present embodiment, the quantity of light emitted by the sensor is set equal for all recording head patterns. Further, the sensitivity adjusting portion 204 adjusts, for each recording head, the threshold used for comparison carried out by the comparator.

With reference to FIG. 3, description will be given of a method for adjusting the threshold and a method for measuring the amount of offset according to the present example.

The recording carried out and the patterns used in step S1 are similar to those in the first embodiment.

In step S2, the patches 401 to 403 recorded in step S1 are subjected to photometric processing. First, the carriage 102 is moved in the direction of the arrow in FIG. 4 from the left of this figure to a position where an almost central area of the patch 401 can be subjected to photometric processing by the sensor 107 mounted on the carriage. Then, the threshold for the comparator is gradually changed with the light quantity level for the sensor light emitting portion fixed to a predetermined value. Then, a threshold for black is determined to be the one obtained when the sensor reacts, i.e., when a pattern of density 50% is detected with the fixed quantity of light. This operation is performed for the areas 402 and 403 and for the other colors.

An object of the present embodiment is also to precisely distinguish a pattern of 100% density from a blank portion of a sheet to accurately detect an edge portion of the pattern. Thus, the position of the recorded pattern is accurately detected by setting the threshold to be the quantity of light received with a pattern of density about 50%, which quantity is intermediate between the quantity of light received with the pattern of density 100% and that with the blank portion. However, also in the present embodiment, the density of the above pattern is not necessarily limited to 50%. The present embodiment is effective provided that a proper density is used which is between 0 and 100% and which allows the blank portion to be reliably distinguished from the pattern of 100% density.

In step S3, processing is executed which is required if an error occurs. The term "error" as used herein refers to the case in which the threshold obtained from a patch of a certain color is smaller than that obtained from the blank portion 402 or larger than that obtained from the pattern of density 100%. In this case, the user is notified of the error and the photometric processing is terminated.

Steps S1 to S3, described above, comprise the adjustment of the threshold.

In step S4 and the succeeding steps, the threshold set as described above is used to actually measure the amount of offset to determine a correction value. Here, first, description will be given taking the correction of the recording position in the main scanning direction by way of example.

In step S4, offset measuring patterns are subjected to photometric processing while changing the threshold depending on the threshold level for each color obtained in step S2.

An actual reading operation will be described with reference to FIG. 10. First, the recording medium 115 is transferred to a position where the reference image a-ref1 and the recorded image a-H can be read during a single main scanning operation. Then, with the recording medium 115 fixed, the recorded images are read while moving the carriage at the constant velocity V in the forward main scanning direction. The threshold 204 used for comparison with the images a-ref1 and a-H carried out by the comparator 203 is already set at the value obtained in step S2, i.e., the value for black obtained by reading the patch 401.

Then, the recording medium is further transferred in the sub-scanning direction and fixed to a position where the reference image a-ref1 and the recorded image b-H can be read during a single main scanning operation. Then, the recorded images are read while moving the carriage at the constant velocity V in the forward main scanning direction as previously described. However, in this case, the reference image a-ref1 is subjected to photometric processing using the threshold for black as described above, but for the recorded image b-H, the threshold is switched to the one for cyan obtained by reading the patch 403 in step S2.

Figure 8:
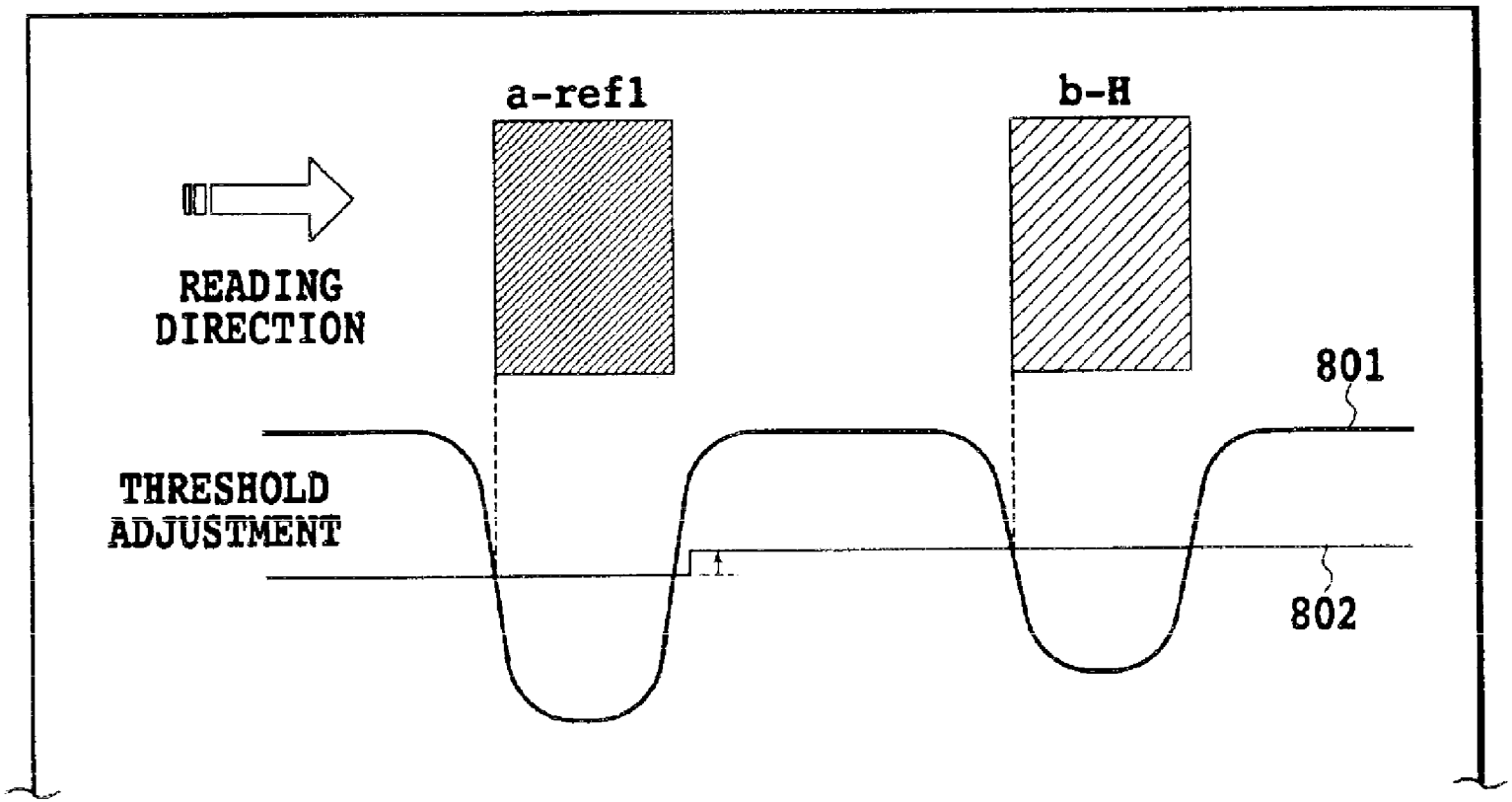
FIG. 8 is a drawing for describing pattern reading control according to a second embodiment of the present invention.

FIG. 8 shows an output voltage from the sensor which is obtained when the images a-ref1 and b-H are read. FIG. 8 indicates that after the reference image a-ref1, recorded with the black ink, has been read, the threshold is switched to the one for cyan. Thus, even if patches with different color tones are read, it is possible to substantially equalize timings for falling edges appearing when the sensor passes over the edges. Consequently, the positions of the edges shown by the dot lines in the figure can be recognized almost equivalently.

Such a waveform is an output signal from the sensor output adjusting means in FIG. 2. It is outputted to the counter 206 of the image interval measuring means as it is. The counter 206 is triggered when the output signal dips from the falling edge threshold. The counter 206 then keeps counting up till the next falling edge. The lower part of FIG. 10 shows the <reference clock> waveform obtained and the <counter operation> performed during the corresponding period.

Step S5 and the succeeding steps are similar to those in the first embodiment.

Further, when an image is actually recorded, the image recording means 210 is controlled using the adjustment value for each recording head set in step S6 as in the case with the first embodiment.

The correction of the offset in the main scanning direction has been described above with reference to FIG. 10. For the offset in the sub-scanning direction, step 4 and the succeeding steps may be executed in the same manner as that of the first embodiment, described with reference to FIG. 11, while setting the threshold for each color obtained in step S2 in FIG. 3.

As described above, according to the second embodiment, the threshold is adjusted for each ink color, the threshold being compared by the comparator with the signal value for the quantity of light received by the reflection-type optical light-quantity sensor. Then, measurement is made of the amount of offset in the main scanning direction or the sub-scanning direction. With this method, the sensor reading errors have been reduced to enable the offset of the recording position to be more accurately corrected.

(3) Other Embodiments

In the above two embodiments, the color recording apparatus for black, cyan, and yellow has been described taking the recording apparatus shown in FIG. 1, by way of example. However, the present invention is not limited to this aspect. For example, a single recording head may correspond to plural types of inks having the same color and different optical densities or a plurality of heads may be provided for different densities of dot array. Then, an appropriate combination of these recording heads may be mounted on the carriage 101 to switch between the formation of monochrome images and the formation of color images, between the formation of binary images and the formation of halftone images, or the like. In any case, the mounted recording heads are properly corrected by carrying out the above automatic correction mode.

Further, in the present invention, as examples of adjustment of the reflection-type original light-quantity sensor, two methods have been described as separate embodiments: the method for adjusting the quantity of light as disclosed in the first embodiment and the method for adjusting the threshold as disclosed in the second embodiment. However, in the present invention, these adjustment methods need not necessarily be executed independently. The present invention is effective even when one of these methods is used depending on the type of recording media or the recording mode or when both methods are simultaneously executed.

Furthermore, in the above description, the present invention is applied to an ink jet-based recording apparatus that forms an image by ejecting ink from recording heads onto a recording medium. However, the present invention is also applicable to recording apparatuses based on other methods as long as the recording position is desirably corrected among a plurality of recording heads in these apparatuses.

As described above, according to the present invention, regardless of the color tone of the offset measurement pattern, the edge portion of the pattern is precisely detected to accurately determine the amount of offset of the recording position of each recording head. Therefore, with this method, the offset of the recording position has been successfully corrected more accurately.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A recording apparatus that forms an image by relatively scanning a recording medium and a plurality of recording heads used to apply recording agents of different color tones to the recording medium, said apparatus comprising:

image forming means for causing each of said plurality of recording heads to form a predetermined image at a predetermined position of the recording medium;

image detecting means for detecting each predetermined image by being scanned relative to the recording medium;

image detection adjusting means for adjusting said image detecting means when detecting the predetermined image formed by each of said plurality of recording heads;

measurement means for measuring an interval between predetermined images formed by said plurality of recording heads on the basis of output results obtained by said image detecting means; and data processing means for calculating the amount of offset of a recording position among said plurality of recording heads on the basis of the measurement made by said measurement means, wherein said image detection adjusting means causes said image forming means to form adjustment images at predetermined positions of the recording medium using respective recording heads, the adjustment images being used to make adjustment when the predetermined images are detected, and wherein said image detection adjusting means causes said image detecting means to detect the adjustment images to adjust said image detecting means on the basis of output results obtained by the detection.

2. A recording apparatus as claimed in claim 1, further comprising correction means for correcting the offset of the recording position among said plurality of recording heads by correcting image data to be formed by said plurality of recording heads or timings used to record images on the recording medium, on the basis of the amount of offset of the recording position calculated by said data processing means.

3. A recording apparatus as claimed in claim 2, further comprising means for scanning said plurality of recording heads relative to the recording medium in a main scanning direction and wherein the predetermined images are formed by said respective recording heads so as to lie in a line in the main scanning direction, and on the basis of the measurement of the interval between the predetermined images and the amount of offset calculated on the basis of the interval, said correction means corrects the offset of the recording position among said plurality of recording heads in the main scanning direction.

4. A recording apparatus as claimed in claim 2, further comprising means for moving the recording medium relative to said plurality of recording heads in a sub-scanning direction and wherein the predetermined images are formed by said respective recording heads so as to lie in a line in the sub-scanning direction, and on the basis of the measurement of the interval between the predetermined images and the amount of offset calculated on the basis of the interval, said correction means corrects the offset of the recording position among said plurality of recording heads in the sub-scanning direction.

5. A recording apparatus as claimed in claim 1, wherein said image detecting means comprises a light emitting portion that emits light to the recording medium and a light receiving portion that detects the quantity of light reflected by the recording medium.

6. A recording apparatus as claimed in claim 5, wherein the quantity of light received which is detected by said light receiving portion of said image detecting means varies depending on the average density of an area to which light is emitted by said light emitting portion.

7. A recording apparatus as claimed in claim 6, wherein when detecting the predetermined images while moving relative to the recording medium, said image detecting means determines a point of time when the quantity of light reflected which changes at a boundary between an unrecorded area and a recorded area exceeds a predetermined threshold, to correspond to an edge portion of each predetermined image, and said measurement means measures the interval between the predetermined images on the basis of a timing with which the edge of the predetermined image formed by each of said plurality of recording heads is detected.

8. A recording apparatus as claimed in claim 7, further comprising means for scanning said plurality of recording heads relative to the recording medium in a main scanning direction and wherein the predetermined images are formed in the main scanning direction by said respective recording heads, wherein said image detecting means detects the predetermined images while moving relative to the recording medium at a constant relative velocity in the main scanning direction, and wherein said measurement means determines the interval between the predetermined images formed by said plurality of recording heads by measuring the distances between the respective edges of the predetermined images on the basis of a product of a time interval at which the edges are detected and the relative velocity.

9. A recording apparatus as claimed in claim 7, further comprising means for moving the recording medium relative to said plurality of recording heads in a sub-scanning direction and wherein the predetermined images are formed in the sub-scanning direction by said respective recording heads, wherein said image detecting means detects the predetermined images while moving relative to the recording medium at a constant relative velocity in the sub-scanning direction, and wherein said measurement means determines the interval between the predetermined images formed by said respective recording heads by measuring the distances between the respective edges of the predetermined images on the basis of a product of a time interval at which the edges are detected and the relative velocity.

10. A recording apparatus as claimed in claim 1, wherein the adjustment images are a plurality of patches recorded by said respective recording heads so as to have respective uniform densities, wherein said image detection adjusting means determines a light emission quantity by which a quantity of light received when said image detecting means detects a central portion of each of the patches is equal to the predetermined threshold, to be an adjustment light emission quantity for each of said plurality of recording heads, and wherein when the predetermined images are detected, the respective adjustment light emission quantities are used for the corresponding images formed by said plurality of recording heads.

11. A recording apparatus as claimed in claim 1, wherein the adjustment images are a plurality of patches recorded by said respective recording heads so as to have respective uniform densities, wherein said image detection adjusting means determines the quantity of light received when said image detecting means detects a central portion of each of the patches with a predetermined light emission quantity, to be an adjustment threshold for each of said plurality of recording heads, and wherein when the predetermined images are detected, the respective adjustment thresholds are used for the corresponding images formed by said plurality of recording heads.

12. A recording position correcting method for a recording apparatus that forms an image by relatively scanning a recording medium and a plurality of recording heads used to apply recording agents of different color tones to the recording medium, said method comprising:

an image forming step of causing each of the plurality of recording heads to form a predetermined image at a predetermined position of the recording medium;

an image detecting step of detecting each predetermined image using image detecting means scanned relative to the recording medium;

an image detection adjusting step of adjusting the image detecting means when detecting the predetermined image formed by each of the plurality of recording heads;

a measurement step of measuring an interval between predetermined images formed by the plurality of recording heads on the basis of output results obtained in said image detecting step;

a data processing step of calculating the amount of offset of a recording position among the plurality of recording heads on the basis of the measurement; and a step of recording the images while correcting the amount of offset obtained by the data processing, wherein said image detection adjusting step causes said image forming step to form adjustment images at predetermined positions of the recording medium using respective recording heads, the adjustment images being used to make adjustment when said predetermined images are detected, and wherein said image detection adjusting step causes the image detecting means to detect the adjustment images to adjust the image detecting means on the basis of output results obtained by the detection.

* * * * *